United States Patent [19]

Fisher et al.

[11] Patent Number: 4,736,496

[45] Date of Patent: Apr. 12, 1988

[54] CLOSURE FOR THERMOPLASTIC CONTAINERS

[75] Inventors: Julie M. Fisher; Dennis R. Tumminia, both of Midland, Mich.

[73] Assignee: The Dow Chemical Company, Midland, Mich.

[21] Appl. No.: 453,181

[22] Filed: Dec. 27, 1982

[51] Int. Cl.[4] ..... B65D 33/24

[52] U.S. Cl. ..... 24/587; 383/63; 383/65

[58] Field of Search ..... 383/63, 65; 24/587, 24/576, 577, 588; 425/376 R

[56] References Cited

U.S. PATENT DOCUMENTS

| | | | |
|---|---|---|---|
| Re. 28,969 | 9/1976 | Naito | 383/65 |
| 1,959,318 | 5/1934 | Sundback . | |
| 2,571,144 | 10/1951 | Lobl | 383/63 X |
| 3,338,284 | 8/1967 | Ausnit | 383/65 |
| 3,395,788 | 8/1968 | Gill | 383/63 |
| 3,532,571 | 10/1970 | Ausnit | 383/65 X |
| 4,285,376 | 8/1981 | Ausnit | 383/63 X |
| 4,363,345 | 12/1982 | Scheibner | 24/587 |

FOREIGN PATENT DOCUMENTS

| | | |
|---|---|---|
| 36107 | 10/1969 | Australia . |
| 45646 | 10/1979 | Australia . |
| 54002 | 12/1979 | Australia . |
| 1423839 | 11/1965 | France . |
| 14536 | 4/1981 | Japan . |
| 968953 | 10/1962 | United Kingdom . |

OTHER PUBLICATIONS

Presto Products, Private Label Storage Bags, Jan. 1981.

*Primary Examiner*—William E. Lyddane
*Assistant Examiner*—Peter A. Aschenbrenner
*Attorney, Agent, or Firm*—L. E. Hessenaur, Jr.

[57] ABSTRACT

A method for providing a wide-track integral thermoplastic closure for film or sheet stock. The closure includes ribs on either side of an element of the closure to provide the wide-track effect to assist one in ease of interlocking the closure elements. By varying the thickness of the closure element adjacent the ribs, the spacing of the ribs to provide the desired wide-track feel can be obtained.

12 Claims, 3 Drawing Sheets

CLOSURE FOR THERMOPLASTIC CONTAINERS

BACKGROUND OF THE INVENTION

This invention relates to a method of forming integral fasteners with flexible or rigid film or sheet stock to be made into bags or other containers or products which are closable by fastener elements or into laminatable strips which can form part of such containers or products. One such method of the prior art for forming such fasteners is shown in U.S. Pat. No. 4,263,079 for example. In the particular embodiment shown by that patent, male and female profiles are extruded onto a film base with the male profile adapted to zipper into the female profile for interlocking the bag opening. Sometimes in such bags, however, the width of the base of the male and female closing elements over which the fingers pass for closing are so narrow that it is difficult to get a good feel for aligning the male and female fastener elements together for easy interengagement. One way of broadening the feel for the zipper is to provide additional ribs on both sides of at least one of the fastener elements. While use of additional ribs on either side of a thermoplastic fastener element has been suggested in the past, U.S. Pat. No. Re. 28,969, none of the prior art has taught how to obtain the desired width spacing between the ribs and the fastener elements so as to provide a "good feel" for aligning and closing the fastener elements and to manufacture the same in a way that will provide the preferred spacing between the ribs on either side of a fastener element. Likewise, none of the prior art has indicated what is the best spacing to achieve such a "good feel".

SUMMARY OF THE INVENTION

This invention rests in an improved integral zipper closure for thermoplastic containers or other film or sheet products which require a closure which is readily engagable and disengagable by the ultimate consumer. It has been found desirable to include ribs on both sides of one of the fastener elements or profiles forming the closure to permit one to more readily "feel" the closure when running the fingers over the backs of the profiles forming the closure to engage the interlocking profiles. In a male or female type closure, such as is taught in U.S. Pat. No. 3,340,116 for example, it has been found desirable to include ribs on either side of one of the profiles, preferably the male profile, so that the protrusions of the female profile extend on either side of the male between the ribs. If the ribs are spaced too far from the profile, they do not feel to the fingers as if they are part of the profile. If they are too close, they will not permit room for the engagement of the female over the male nor will the zipper feel much wider than it would without the ribs. Controlling the spacing of the ribs on either side of a profile is thus a primary concern of the present invention.

By this invention, the spacing of the ribs can be controlled and selected so as to permit the desired spacing as one may determine the same to be preferred or through consumer testing of various spacings. Merely cutting a die with a given spacing of the ribs will not normally result in the same spacing in the finished product because of the lateral stresses or forces experienced in the extrusion process which tends to draw ribs apart from the profile. It has been discovered that by increasing or decreasing the thickness of the base of a profile that control of rib spacing can be obtained. Thickening the profile base has been found to cause the ribs to stay closer together and to the profile. Thus, if it is found desirable to have a closer rib spacing, a thicker base on the profile can be provided. If it is desirable to space the ribs further apart, then the thickness of the base is decreased. While profiles with thickened bases have been known, such as in U.S. Pat. Nos. 3,198,228, 3,338,284, and 4,263,079, it has not been known that such thickening can affect spacing of ribs which might be located on each side of a profile. By being able to control the rib spacing in an extrusion process, the desired spacing to achieve the feel of a "wide-track zipper" when closing the fastener elements can readily be obtained.

DETAILED DESCRIPTION OF THE DRAWINGS

Figure 1:
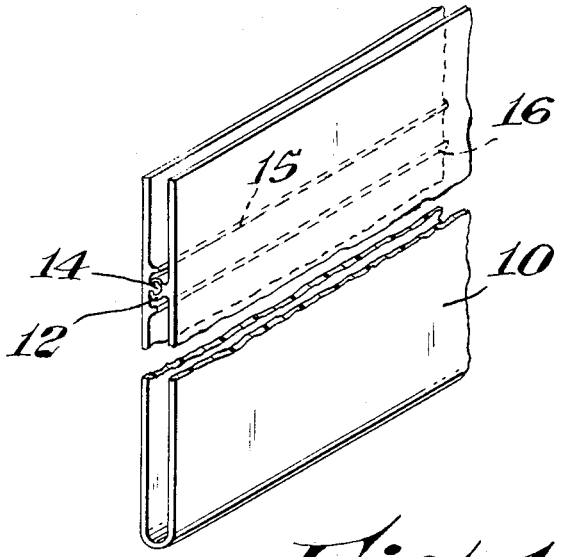
FIG. 1 is a perspective view of a section of a container have a wide-track zipper-type closure.

Integral zipper-type closures can be made by the process such as shown in U.S. Pat. No. 3,340,116, a tubular extrusion process, or a cast process such as shown in U.S. Pat. No. 4,263,079. In each case, the extrudate is formed with a certain amount of lateral forces built into the product, the lateral forces being transverse tensions in the film being formed as compared to the tensions in the extrusion direction. When one incorporates ribs on the sides of a profile, it is the lateral or transverse forces which can affect the spacing between the ribs. Referring more particularly to the drawing, FIG. 1 shows as part of a container 10 a female profile 12 engaged with a male profile 14 to form a closure formed in a bag as shown in the patents referenced immediately above. Adjacent to the closure profile are found raised generally triangular shaped protuberances or ribs or ridges 15 and 16 (FIGS. 3 and 4) spaced approximately the distance D-1 and D-2 from the profile, the distance D-3 being the accumulative distance of D-1 plus D-2.

Figure 3:
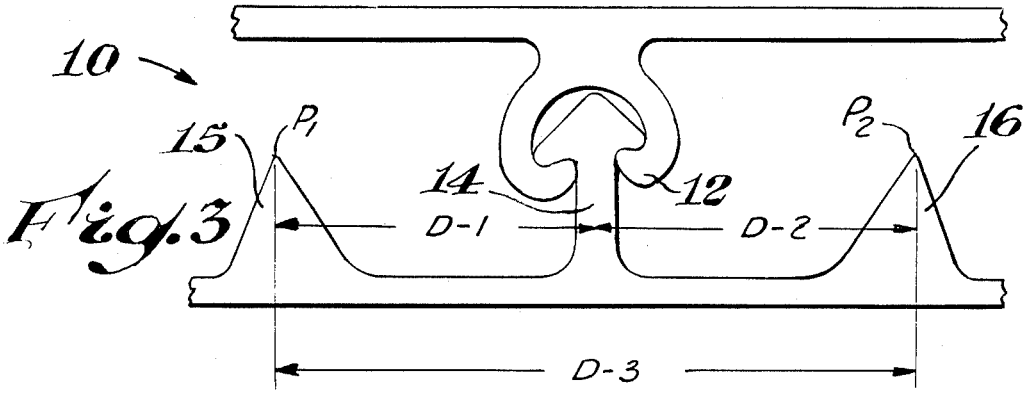
FIG. 3 is a greatly enlarged cross-sectional view of a zipper profile made with widely spaced ribs.
Figure 3A:
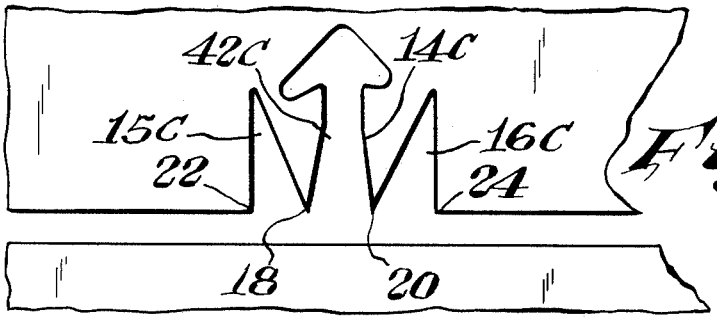
FIG. 3A is a less greatly enlarged die profile cut made so as to provide the profile of FIG. 1.

FIG. 3A is a magnification of the die profile cut through which the male profile 14 and the adjacent ribs 15 and 16 are extruded. The bases 18 and 20 of the cut-out 15*c* for rib 15 and 16*c* for rib 16 adjoins the base of cut-out 14*c* for profile 14 and is at the same and is coplanar with the outside bottom corner 22 and 24 of the cut-outs 15*c* and 16*c*. Despite the fact that the cut-outs 15*c* and 16*c* join at the base of cut-out 14*c*, FIG. 3 shows that the distances between the profile and the ridges, that is distance D-1 and D-2, are substantially great. This is believed to be caused by the lateral or transverse stresses or forces (as compared to forces exerted in the extrusion direction) that are exerted upon the film as it is cooling down and is being stretched immediately following extrusion. Merely cutting a die with a selected spacing of the ribs will not normally result in the same spacing on the final product. When the product is drawn down, after it leaves the die, all dimensions tend to decrease. Furthermore, lateral stresses experienced in the process tend to draw the ribs apart from the profile. On the other hand, whenever a thick component such as a rib is adjacent to a thin component such as the film, the thick section will tend to become narrower and remain thicker yet while the thin section will tend to become wider and thinner yet. In spite of the complex inter-relationship, it has been discovered that increasing or decreasing the thickness of the base of a profile can control the rib spacing.

Figure 4:
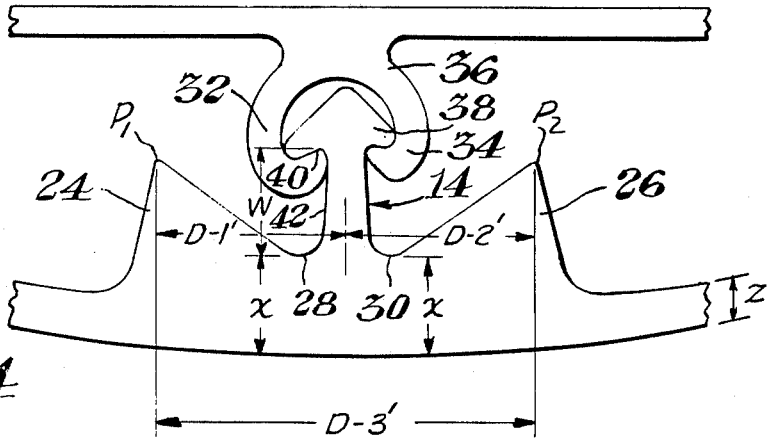
FIG. 4 is a greatly enlarged cross-sectional view of a zipper profile made with more closely spaced ribs than that of FIG. 2.
Figure 4A:
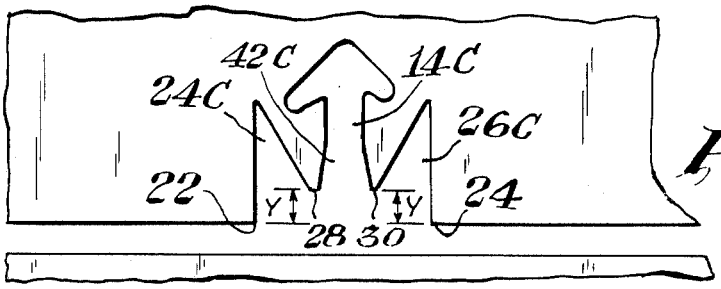
FIG. 4A is a less greatly enlarged die profile cut made so as to provide the profile of FIG. 2.

FIG. 4 illustrates a profile in which the distances between the profile and the ridges is substantially less than that shown in FIG. 3. Specifically, by employing the concept of the present invention, the ribs 24 and 26 are much closer to one another and to the profile 14, the distance D-1′ and D-2′ being approximately half that of D-1 and D-2 of FIG. 3. The way this was achieved was by changing the distance Y (FIG. 4A) where the base of cut-out 24*c* meets the base of profile 14*c* at point 28 and likewise where the base of cut-out 26*c* meets at point 30 the base of profile 14*c*, 24*c* being the extrusion slot through which profile 24 is formed and cut-out 26*c* being the extrusion slot through which rib 26 is formed. The cut-out 24*c* meets cut-out 14*c* at point 28 which is spaced a distance Y above the elevation of the outside of cut-out 24*c* at 22. The same spacing Y occurs for the point 30 where cut-out 26*c* meets cut-out 14*c*.

Figure 2:
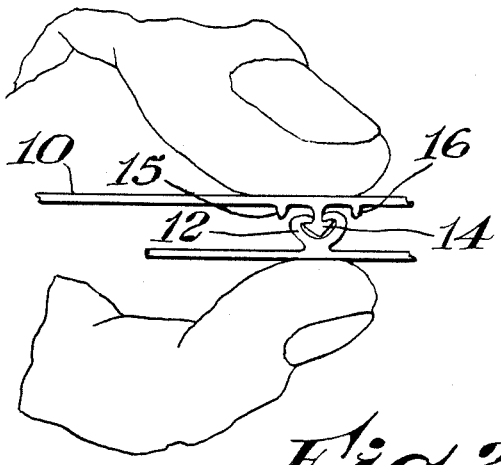
FIG. 2 is an enlarged fragmentary perspective view of a cross-section of closure elements of a wide-track zipper-type closure being interlocked, with a thumb on top being shown as "feeling" the wide-track effect.

What this does is thicken the section represented by the distance X of the profile 14 from the normal thickness Z of the film for the rest of the container as seen in FIG. 4, for example. By increasing the thickness X of the profile 14, it has been found that the peak $P_1$ to peak $P_2$ distance D-3′ between ribs 24 and 26, respectively, decreases. The distances D-1′ and D-2′ are still wide enough to permit the legs 32 and 34 of the female 36 to fit readily around the upper extremity 38 of the profile 14 and yet are close enough so that when one zippers the elements 14 and 36 together, the ribs 24 and 26 give to the closure a feeling of substantial width or, in the case shown, the feeling of a so-called "wide-track" zipper or illustrated in FIG. 2 where the thumb on top can feel the width of the base of the male profile 14 and the ribs 15 and 16 simultaneously upon interengaging of the male and female profiles. The broader base of the wide-track concept appears to result in less pressure on the user's fingertips when interlocking the closure profiles, and consequently creates an improved feel of zipping. The stiffening effect provided by a thicker base X for the profile 14 likely also stiffens the male profile to prevent tipping thereof during the zipping process.

The ribs 24 and 26 are positioned close enough to the male profile so that the ribs and the male profile must move together as a unit. The preferably generally triangular shape of the ribs permits ready engagement of the female profile over the male profile, is generally structurally strong, and has been found to work well in this invention. The ribs and male profile combination shown in FIG. 4, for example, has a higher moment of inertia than the male profile would present alone. This is believed to result in improved resistance to bending by the profile. The degree of resistance can, therefore, be controlled by controlling rib spacing. This is advantageous when zipping the bag as it reduces lateral movement of the male profile relative to the female profile and therefore aids in maintaining alignment of the male and female components.

The distance W between the base 28 of profile 14 and the bottom 40 of extremity 38 represents the stem height of the profile 14. As the distance X (representing the thickness of the base of profile 14) increases, it is important that the stem 42 length W be kept long enough that the legs 32 and 34 of the female profile 36 can easily engage over the extremity 38. This can be achieved by lengthening the stem 42*c* cut-out in the die.

Figure 5:
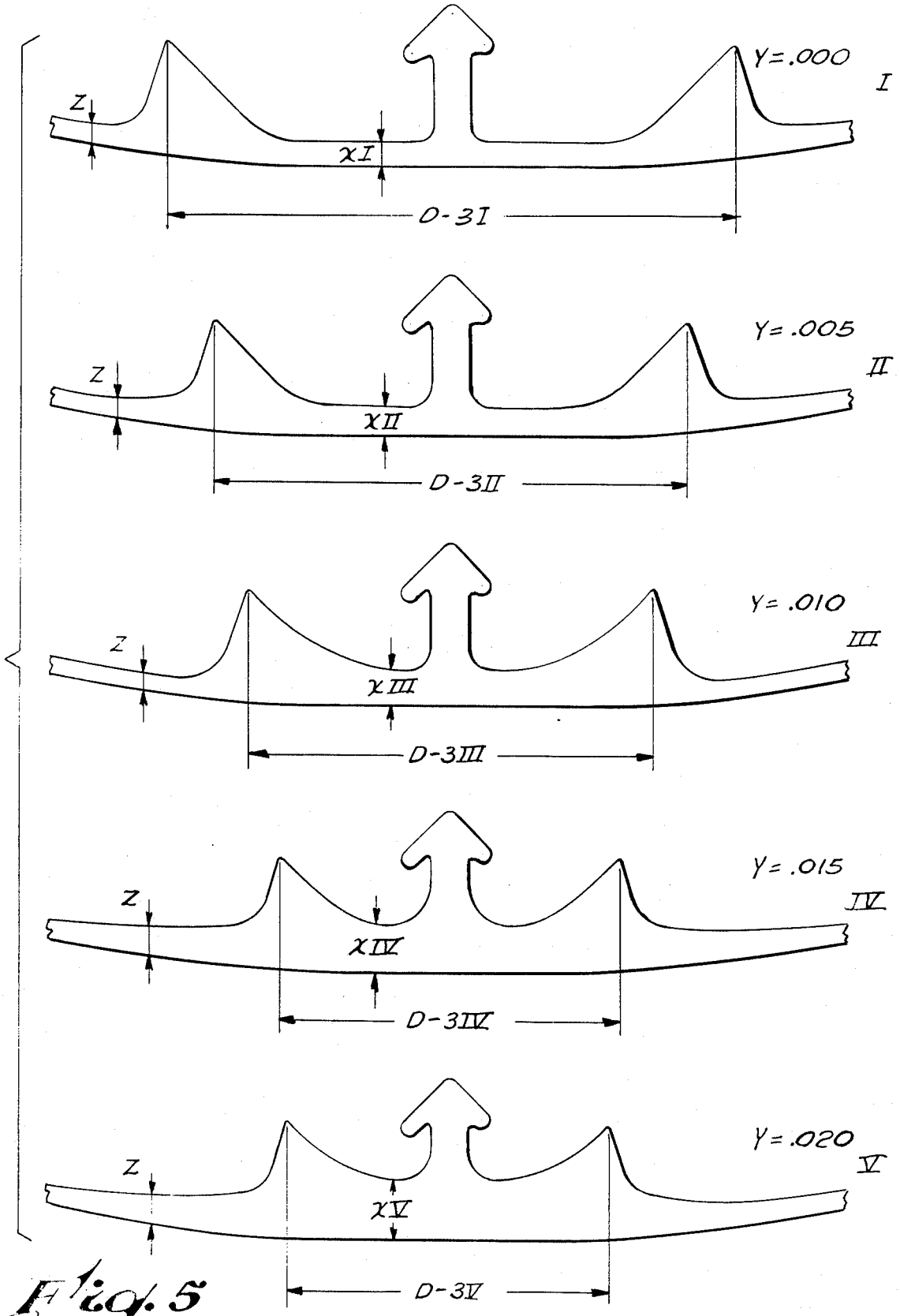
FIG. 5 is an enlarged cross-sectional view of various profiles with, various rib spacings.

FIG. 5 illustrates various closure modifications. Modification I is similar to that of FIG. 3 where the distance X minus Z (called the profile die base) is in effect about zero, the die cut through which this modification is extruded being like that of FIG. 3A where the distance Y is about zero as indicated to the right of Modification I. Modification II is one where the distance Y is about 0.005 inches; Modification III is one where the distance Y is about 0.010 inches; Modification IV is one where the distance Y is about 0.015 inches; and Modification V is one where the distance Y is about 0.020 inches. In each case, as we move from Modification I through Modification V, the spacing of the ribs (spacings D-3I through D-3V, respectively) has been found to get smaller and smaller. It can be assumed that as the Y distance increases even further, the progression or modifications will continue until the rib spacing D-3 is too close to be operable or desirable.

Figure 6:
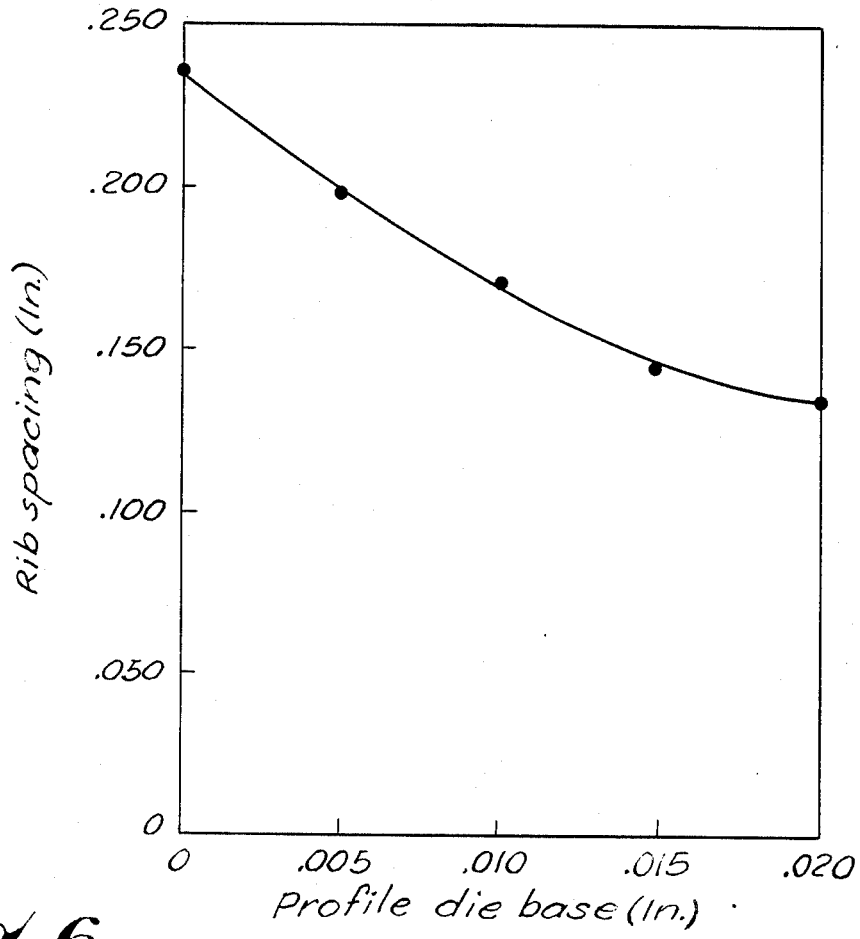
FIG. 6 is a graphical representation of the effect the die profile base has on actual rib spacing.

The actual rib spacing for Modifications I to V of FIG. 5 were plotted graphically as illustrated in FIG. 6. In forming embodiments of Modifications I through V of FIG. 5, the blow-up ratio was kept substantially constant, the temperature of the melt was kept within 2° C. and the temperature of the cooling air was within 2° C., and the air pressure and position of the air cooling means all remained about the same as did the line speed. The actual film gauge, i.e., the distance Z was generally about 1.84 mils. It is believed that the distance D-3 would preferably be about 0.13 to about 0.23 inches for the particular embodiments shown in FIG. 5 but could range from about 0.07 to about 0.30 or perhaps even a greater range depending on closure sizes and materials.

Accordingly, while it is comprehendable that variations within the scope of this invention may be obtained by use of different profiles or different resin materials and differing operating conditions, the principles of this invention would be applicable to many such variations and combinations not here disclosed in detail but falling within the scope of the following claims. For example, whether one feeds the ribs adjacent the profile from the resin supply for the film or instead with the resin supply for the profile, might change the height of the ribs, yet remain within the scope of this invention. Similarly, there may be other ways in which to thicken or thin the base of a profile than that specifically illustrated herein. Likewise, extruding the materials in a cast system as contrasted to a tubular system would generate different levels of lateral stresses and effect actual rib spacing to a degree, yet the processes would still employ the concepts of the present invention. Further, if the dimension Y were something less than positive, rib spacing could still be affected, but then one must look at other possible associated problems, such as excessive thinning, to determine the practicality of such structures. Additionally, protuberances might be placed adjacent to the female profile instead of the male profile or adjacent to both profiles, or the interengaging profiles might take different configurations or be formed of different materials than those used in said film or sheet stock and still present embodiments within the scope of this invention.

What is claimed is:

1. A method of adjusting the spacing of ribs integrally formed adjacent an extruded thermoplastic closure profile formed on film or sheet stock to be made into a bag, said profile having a base and ribs being extruded from a die and joined to the film or sheet stock as it is being simultaneously extruded, wherein the extrusion process introduces lateral stresses and stretching in the film or sheet stock for said integral bag, the improvement comprising cutting openings in said die for the extrusion of the ribs and profile profile bases so the base of each cutout for a rib meets the base of the cut-out for its adjoining profile at a junction, increasing or decreasing the elevation of each junction so as to control the relative spacing between the ribs in the bag during stretching of said film or sheet stock sizing the die cut-out for the base so that the thickness of the base of the profile with respect to the thickness of the film or sheet stock adjacent the junction of the base and the film or sheet stock obtains a spacing between the ribs and the profile in the bag so that the profile and ribs move together as a unit when the profile closure is opened or closed, said base of the profile extending at least to the ribs.

2. The method of claim 1 wherein the size of the die cut-out determining the thickness of the profile base is increased to decrease the rib spacing.

3. The method of claim 1 wherein the size of the die cut-out determined the thickness of the profile base is decreased to increase the rib spacing.

4. The method of claim 1 wherein the closure profile is of a female configuration and the other interengaging profile is of a male configuration, whereby the ribs are extruded on either side of the male profile.

5. The method of claim 4 wherein there is designed a sufficient space between the ribs and male profile to permit the female profile to engage the male profile between the ribs and male profile.

6. The method of claim 5 wherein the base of the male profile leaves a sufficient stem to the male profile as to permit ready engagement with the female profile.

7. The improved closure of claim 10 wherein the crest of said ribs are generally triangularly shaped.

8. The improved closure of claim 10 wherein the distance between said ribs is from about 0.13 inches to about 0.20 inches.

9. A container including an improved closure on thermoplastic film or sheet stock, said closure including oppositely disposed profile elements having interlocking extremities, ribs located on said film or sheet stock adjacent at least one of said profile elements, said ribs of sufficient size and spaced on either side of said profile element so as to move together with the profile element as a unit when the extremities of the closure profile elements are engaged or disengaged and feel like part of the closure itself yet provide sufficient room for interlocking engagement with the extremity of the other profile element, said ribs having a height less than that of the profile element to which they are adjacent yet tall enough to extend beyond ends of and on opposite sides of the extremity of said other profile element whereby at least a portion of the extremity of said other profile element is located between said one profile element and its adjacent ribs, said one profile element having a base extending at least to the ribs and thicker than said film or sheet stock.

10. An improved closure for products made from thermoplastic film or sheet stock, said closure including oppositely disposed profile elements having interlocking extremities, ribs located on said film or sheet stock adjacent at least one of said profile elements, said ribs of sufficient size and spaced on either side of said profile element so as to move together with the profile element as a unit when the extremities of the closure profile elements are engaged or disengaged and feel like part of the closure itself yet provide sufficient room for interlocking engagment with the extremity of the other profile element, said ribs having a height less than that of the profile element to which they are adjacent yet tall enough to extend beyond ends of and on opposite sides of the extremity of said other profile element whereby at least a portion of the extremity of said other profile element is located between said one profile element and its adjacent ribs, said one profile element having a base extending at least to the ribs and thicker than said film or sheet stock.

11. The improved closure of claim 9 wherein the crest of said ribs are generally triangularly shaped.

12. The improved closure of claim 9 wherein the distance between said ribs is from about 0.13 inches to about 0.20 inches.

* * * * *

UNITED STATES PATENT AND TRADEMARK OFFICE

CERTIFICATE OF CORRECTION

PATENT NO. : 4,736,496

DATED : April 12, 1988

INVENTOR(S) : Fisher et al.

It is certified that error appears in the above-identified patent and that said Letters Patent is hereby corrected as shown below:

On the cover page, Item [75], the inventorship should read --Julie M. Fisher; Dennis R. Tumminia; R. Douglas Behr, all of Midland, Michigan--.

Signed and Sealed this

Eleventh Day of April, 2000

*Attest:*

*Attesting Officer*

Q. TODD DICKINSON

*Director of Patents and Trademarks*